United States Patent [19]

Guridi et al.

[11] Patent Number: 4,946,030

[45] Date of Patent: Aug. 7, 1990

[54] EMERGENCY KEY HOLDER CARD

[76] Inventors: Jose J. S. Guridi, 2000 Bering Dr., #805, Houston, Tex. 77057; Jerry D. Perdue, Rte. 4, P.O. Box 4714, Porter, Tex. 77365

[21] Appl. No.: 208,572

[22] Filed: Jun. 20, 1988

[51] Int. Cl.[5] ..... A45G 11/32

[52] U.S. Cl. ..... 206/37.1; 206/38.1

[58] Field of Search ..... 206/0.81, 38, 38.1, 206/37, 37.1

[56] References Cited

U.S. PATENT DOCUMENTS

| | | | |
|---|---|---|---|
| 2,071,021 | 2/1937 | Brandt | 206/37.1 X |
| 2,552,699 | 5/1951 | Wanfield | 206/37.1 |
| 3,144,935 | 8/1964 | Geyler | 206/37.1 X |
| 3,212,546 | 10/1965 | Lind | 206/37 |
| 4,037,716 | 7/1977 | Marks | 206/37.1 X |
| 4,286,641 | 9/1981 | Watson | 206/37 X |
| 4,300,610 | 11/1981 | China | 206/37 X |

*Primary Examiner*—William Price

*Attorney, Agent, or Firm*—Matthews & Associates

[57] ABSTRACT

An emergency key holder card which includes a credit card sized key holder card retaining emergency keys, as well as, various other incidentals. The keys may be separably retained within corresponding apertures of the card, or may be separably, hingedly attached to the emergency key holder card such that they may pivot into and out of the plane of the card. The hinge means provided pursuant to this invention allows for each key to be separated from the card at the preference of the user. Each key may be separably retained within the key holder card by means of a tab and corresponding recess arrangement, by manufacturing the key such that each non-cut edge directly abuts the corresponding key aperture edge of the key holder card, or by a separable hinge means as described above. Each key may also be separably retained within corresponding key shaped apertures. The convenience of the key holder card is further advanced by the incidentals retained within, or inscribed on the key holder card, including various linear measuring devices, toothpicks, identification labels, an emergency coin holder, manifying glass, or calendar. The keys may also be retained within their corresponding aperture by a series of bands which transverse the key aperture defined within the emergency key holder card. Thereby securing any average household or automotive key constructed of most any material. The emergency keys may be plastic to enhance the convenience and flexibility of the key holder card. The present invention may alternatively retain one to three keys of various size, shape and material within a completely enclosed key holder card.

2 Claims, 5 Drawing Sheets

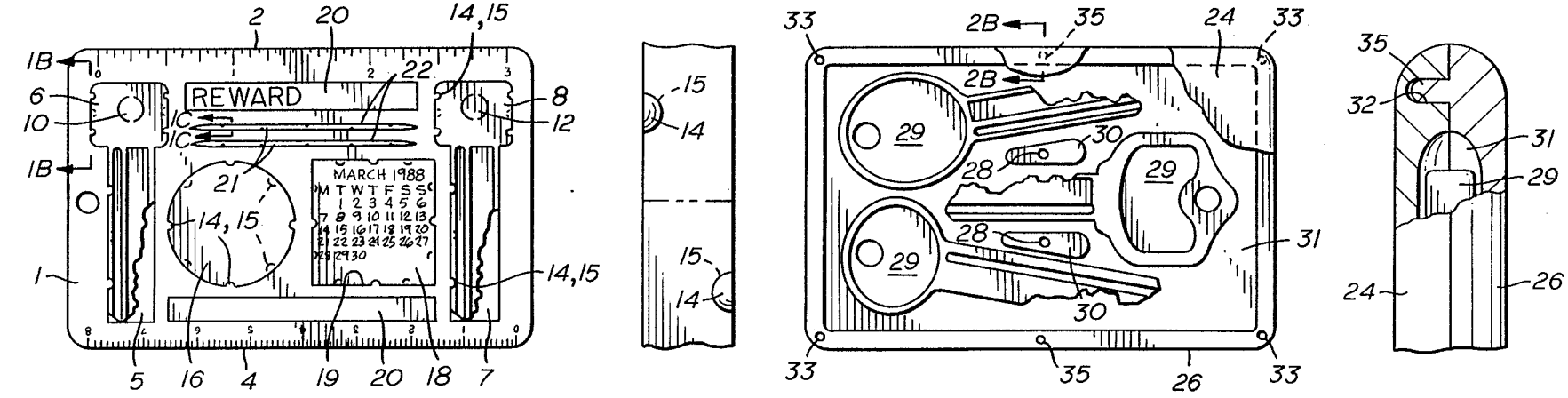
FIG. 1A
FIG. 1B
FIG. 2A
FIG. 2B
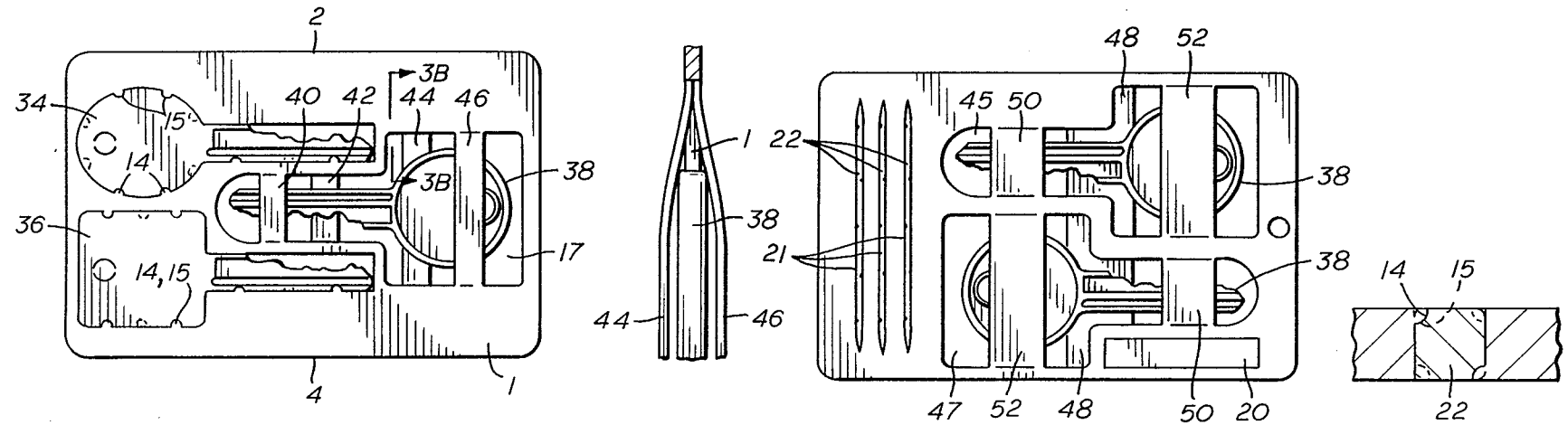
FIG. 1C
FIG. 4A
FIG. 3B
FIG. 3A

EMERGENCY KEY HOLDER CARD

BACKGROUND OF THE INVENTION

1. Field of the Invention

This invention relates to key holders or retainers and more particularly to a credit card sized holder for emergency keys and other miscellaneous articles including toothpicks, magnifying glass, emergency phone number, emergency quarter and measuring instruments. Still further, this invention relates to a credit card sized emergency key holder which allows the keys to be removed, re-inserted and stored in the holder.

2. Description of the Prior Art

Kayhill, U.S. Pat. No. 1,766,599 discloses a combined paper currency, ring and key holder. The holder is comprised of a plate of resilient sheet metal with a series of fixably attached parallel vertically disposed clips, three opening downwardly and two opening upwardly. A safety pin is permanently secured to the bottom of the horizontal edge of the sheet metal plate to allow one to secure the holder to clothing, pockets, bags and the like.

Loesch, U.S. Pat. No. 2,228,726 discloses a key case comprising a receptacle comprising two hingedly attached triangular sections which can be closed together and secured. Within each hinged section is located three key hangers hingedly mounted near each corner of each section, said hangers having a trough for the reception of the key head and spring members adapted to urge the key into the trough.

Campbell, U.S. Pat. No. 2,322,920 discloses a key holder with a substantially flat container provided with a plurality of key receiving compartments. The compartments are arranged so that the peripheral edges of the material forming the compartments terminates substantially in a common plane. The peripheral edges of the material forming the compartments is elastic and sufficiently rigid to resist edgewise pressure such that the edges of the compartments not selected for the particular key to be removed or inserted cooperate to maintain the openings to the other compartments in use.

Dimond, U.S. Pat. No. 2,625,190 discloses a key case of substantial thickness which includes a container for holding said keys. A supporting member is found within the container which extends along and is secured to one end of the container. Said supporting member having a plurality of fingers which extend in a parallel spaced relation with means integrally connected with the free ends of the fingers to allow for holding keys in an orderly aligned position within the container.

Sherwood, U.S. Pat. No. 2,625,191 discloses a pocket key case comprising a pair of walls of flexible material, leather or the like, with a tab on the end of one of the walls and a tab on one end of the other wall such that when the tabs are turned inward a key chain is passed between the eyelets of the tabs, said chain passing through the aperture found in the head of keys and retaining said keys within the disclosed pocket key case.

Goessling, U.S. Design Pat. No. 174,543 which discloses a combination coin purse and key holder.

Ferber and Gannon, U.S. Pat. No. 2,859,788 discloses key holders comprising unitarys length of flat, resilient metal bent into a U-shape with the flat ends opposing each other, a single post disposed transversely across the top portion of the U, said post being integrally attached to the upper end portion of one arm and extending outwardly toward the other arm with the extreme outer face normally abutting, with spring pressure, against the inside upper portion of the other arm of the U. Further, a flexible case within which the holder element is retained is also disclosed.

Buckett, U.S. Pat. No. 2,859,789 discloses a key holder comprising a thin flat resilient plate with an elongated aperture therethrough in the general shape of a key with first and second straps formed integrally with the plate and extending transversely across the aperture on both sides of said plate somewhat offset from each other for confining a key between the straps within the aperture.

Bermingham and Stiller, U.S. Pat. No. 3,101,762 discloses a key case generally comprising a rigid enclosure with one or more apertures to allow for a key to slide through. The key is slidably mounted within the key case such that the key slides out of the case exposing the entire shaft and a portion of the key head. The user can grasp either the key or the entire case when using the desired key.

Lind, U.S. Pat. No. 3,212,546 discloses a key holder which is comprised of compartments for the keys to be placed within, said keys being held within the apertures magnetically. The keys must be capable of being attracted and retained by a magnet.

Borisof, U.S. Pat. No. 3,318,354 discloses a three section key case, similar to a wallet. The keys are hingedly mounted to the top of the case. The hinge allows the keys to be pulled upwardly and outwardly from the case while remaining attached.

Watson, U.S. Pat. No. 3,606,777 discloses a key holder formed in a single plastic piece with a flat rectangular central portion which in turn is connected to a pair of flat outer flexible key enclosing members in order to form four key receiving compartments. The outer key covering members are cut away to provide access to the key compartment. The keys pivot at protrusions which are formed at each side of the central portion.

Shee, U.S. Pat. No. 3,933,017 discloses a key holder and rack therefore. The key holder consists of a flat sheet and bifurcated fastener that holds one or more keys to the sheet by its spinnable legs.

Marks, U.S. Pat. No. 4,037,716 discloses a pocket sized card holder for keys and/or coins. The holder contains a recessed region for receiving and containing items with a pressure receivable, at least partially adhesively coated lid which covers the depressed region and which can be stripped or peeled back to expose the contained items.

Mowry, U.S. Design Pat. No. 245,371 discloses a key holder card generally designed for car keys. The card contains apertures for the heads of each of the two car keys to be stored. Other apertures are located within the holder which retain the shafts of the keys being retained.

Holmes, U.S. Design Pat. No. 259,073 discloses a spare key holder generally comprising a single aperture within a card where keys are to be placed. Three parallel bands attached transversely across the aperture are located on the card, two on one side, one on the opposite side. The bands are intended to contain the keys within the aperture.

Watson, U.S. Pat. No. 4,286,641 discloses a combination business card and key storage device. This invention comprises an enclosure for storing one or more keys in singular compartments; the enclosure being sized and shaped as a conventional credit card with apertures on one side to allow for insertion of the keys. The inside storage department itself is sub-divided into two separate compartments corresponding to the two apertures through which the keys are inserted.

Toyoda, U.S. Pat. No. 4,454,737 discloses a key holder which includes a body and key shaft which is pivotably mounted on the body such that it can be swiveled or pivoted between the operating position and a non-operating position in which the key is housed within the body.

Kilpatrick, U.S. Design Pat. No. 278,574 discloses a spare key holder which is comprised of four individual key holding recesses in the rectangular shaped key holder. Across each key recess are two key retaining straps.

Almblad, U.S. Pat. No. 4,637,236 discloses a key and retainer card combination. The key and card combination contains at least one recess or a pair of recesses for a set of keys. The structure is intended to separably retain a plastic key in its recess.

Almblad, U.S. Pat. No. 4,677,835 discloses another key and retainer card combination manufactured of plastic. This invention discloses a key and card combination formed of molded plastic material comprising a key shaped recess socket in the plane of a card; the key being severably located in the recessed pocket and formed in one piece with the card with an integral multi-directional hinge. The above referenced prior art fails to disclose a credit card sized emergency key holder comprising the versatility and convenience of the present invention.

OBJECTS OF THE INVENTION

It is an object of this invention to provide a novel emergency key holding apparatus approximately the size and thickness of a credit card which can conveniently hold and store emergency car, house and other type keys.

It is another object of this invention to provide a new and improved emergency key holder card which separably retains a variety of keys as well as toothpicks, magnifying glass and monthly calendar.

It is still another object of this invention to provide a new and useful emergency key holder card manufactured of plastic or similar material which is easily flexible and fits comfortably in ones wallet.

It is yet another object of this invention to provide a new and improved emergency key holder card which can be easily manufactured using today's standard plastic injection molding processes.

It is still another object of this invention to provide a new and useful emergency key holder card which contains a single recessed compartment which can hold up to three keys of various sizes and shape.

It is still another object of this invention to provide a new and improved emergency key holder card which can separably retain two plastic emergency car keys and one metal emergency house key.

It is still another object of this invention to provide a new and improved emergency key holder card which can separably retain two plastic emergency car keys and one metal emergency house key.

It is still another object of this invention to provide a new and improved emergency key holder card which can retain emergency keys in individual recessed compartments shaped similar to the average key, said recessed compartment containing an adhesive surface to retain the keys once placed in the recess.

It is still another object of this invention to provide a new and improved emergency key holder card which contains a single key head separably attached within an aperture of the key holder which in turn is separably attachable to various key shafts retained within the same key holder card.

It is still another object of this invention to provide an emergency key holder card which contains emergency keys which are rotatably separably attached to the main card body and are also separably retained within apertures of the same card body thereby allowing the keys to be retained in the same plane as the key holder when not in use and snap out of the aperture and easily pivotable about their connection point with the key holder body for easy use or completely separated from the card.

It is still another object of this invention to provide an emergency key holder card which contains individual key apertures and emergency keys hingedly attached such that the keys when not in use, can be separably retained within the apertures.

Still other objects of this invention will become obvious and apparent from time to time throughout the specification as set forth herein below.

SUMMARY OF THE INVENTION

The new and improved emergency key holder card of the type according to the present invention is characterized by the fact that individual keys can be separably, hingedly and pivotably retained or attached to and within an emergency key holder approximately the size, width and shape of a credit card. Also retained within the key holder can be an emergency quarter, calendar, toothpicks and linear measuring devices.

The present invention can be manufactured using several embodiments. Each embodiment is easily manufactured using normal injection molding processes used world wide today. Each characteristic of the various embodiments disclosed below has been carefully considered to allow for easy manufacturing. While various other emergency key holders have been invented and produced none contain the convenience, longevity and simplicity of the present invention.

The present invention discloses various new and useful emergency key holder cards. These key holder cards can retain one or more keys in one or more ways. Many of the embodiments are described with a certain number of keys. This number can be increased or reduced for any of the embodiments pursuant to any individual preferences. All keys are retained in either a completely enclosable recess, an aperture in the card itself or an open recess in the card. The toothpicks, emergency quarter and other materials can easily be included with the card at the discretion of the manufacturer or customer. The keys can be retained in the apertures or recesses with a plurality of offset tabs, hinges, pivotable attachments, a plurality of off-set bands, or adhesive. In all of the embodiments, the key can be easily separated from the card itself for use and then simply snapped or placed back into the recess or aperture of the card for storage. Therefore, even after use, the key is always conveniently available for reuse. Using proper manufacturing techniques and proper materials the emergency keys can generally be assumed to last a lifetime.

The emergency keys used will generally be manufactured of plastic or aluminum; however, any light weight metal or plastic is acceptable.

Additional features of the present invention will become apparent from the description of the preferred embodiments of the invention set forth below with reference to the accompanying drawings.

BRIEF DESCRIPTION OF THE DRAWINGS

Further details are explained below with the help of the examples illustrated in the attached drawings in which:

FIG. 1A is a plan view of one embodiment of the emergency key holder card of the present invention;

FIG. 1B is a cross-section view along the line of 1B—1B in FIG. 1A;

FIG. 1C is a cross-section view along line 1C—1C of FIG. 1A;

FIG. 2A is a largely broken away view of an emergency key holder card with a single compartment recess for key storage;

FIG. 2B is a cross-section view along line 2B—2B in FIG. 2A;

FIG. 3A is a plan view of another embodiment of the present invention disclosing two emergency keys retained with tabs and a third emergency key retained with bands;

FIG. 3B is a cross-section view along line 3B—3B of FIG. 3A;

FIG. 4A is a plan view of yet another embodiment of the present invention;

DESCRIPTION OF THE PREFERRED EMBODIMENT

Figure 6:
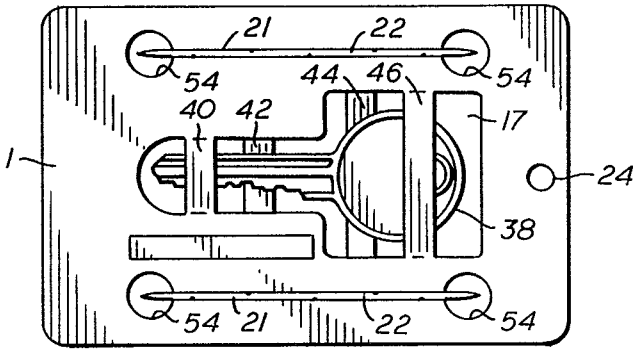
FIG. 6 is a plan view of simplified version of the present invention.

Referring to FIG. 1A, there is shown a rectangular emergency key holder card 1. Retained within said card are various items. First, it can be seen that located along each of the longer edges are linear measuring rulers 2 and 4 used to measure inches and centimeters respectively. Longitudinal apertures 5 and 7 are located parallel to each other on opposite ends of card 1. Within said apertures 5 and 7 are located emergency keys 6 and 8 respectively. The keys 6 and 8 possess circular openings at the top center portion of the key heads 10 and 12 respectively to allow one to place the keys on a key chain or key ring once disconnected from the card. These keys are retained within the recesses by a plurality of tabs 14 located about the head and along the shaft where the shaft is adjacent to the edge of the apertures 5 and 7. Further, tabs 14 are spaced on either side of the card 1 and accordingly the apertures 5 and 7. The tabs correspond to recesses 15 in the key. This same type of tab and recess arrangement is used to hold in place a coin or magnifying glass in aperture 16 and a calendar 18 in aperture 19. FIG. 1B can be referred to in order to illustrate in greater detail the tab and recess arrangement. Also retained within the card 1 are toothpicks 22. The toothpicks 22 are retained within apertures 21 using the corresponding tabs 14 and recesses 15. The tabs 14 and recesses 15 arrangement for the toothpicks is shown more clearly in FIG. 1B. Finally, FIG. 1A discloses a recessed rectangular sections 20 wherein an adhesive backed label can be placed which includes identification and emergency information.

FIG. 2A discloses a two piece emergency key holder card. The bottom section of the card 26 has a recessed compartment 31 which is intended to house the keys 29. Centrally located in the compartment are two posts 30 which rise up from the floor of said recessed compartment. The posts 30 provide separation for the keys 29 housed within the compartment 31. Six pegs are spaced about the edges of the bottom section 26. One peg 33 is located at each of the four corners of the bottom section 26 of the key holder as well as two pegs 35 being placed equidistant from the corners of the longer sides of the rectangular shaped holder. Two other pegs 28 are located on the bumper post 30; these pegs being longitudinally aligned with the two pegs 35. The holder cover 24 contains eight cylindrical recesses 32 which correspond to the eight pegs 28, 33 and 35. These recesses 32 are intended to be exactly the same or marginally smaller in diameter than the pegs 28, 33 and 35 to allow for the cover 24 to be snapped onto the bottom 26 of the holder. This design allows for the housing of one to three keys of various thickness and size.

FIG. 3A discloses yet another embodiment of the present invention. This figure discloses the credit card body 1, again with linear measuring rulers 2 and 4. This embodiment contains 3 apertures for housing keys. All three apertures are arranged horizontally within the card 1. The apertures are arranged from top to bottom such that they are in the general shape of a key and once the key is placed within the aperture every other shaft is targeted to an opposite edge of the card 1. The figure as shown shows two car keys 34 and 36 both with the key heads on the same side of the card 1. These keys are held in place by the tabs 14 and recesses 15 arrangement, as described above. The other key which could be a house key or any other type of key is held within its aperture 17 by a series of bands which are integrally connected to the card 1 and are attached transversely across the third aperture 17. The bands are arranged such that when viewing the face of the card, from left to right, the first band 40 and last band 46 will generally have a top plane which is even with the face of the card when a key is not being held in place. All bands 40, 42 44 and 46 are approximately one-half the thickness of the card 1. Bands 40 and 46 generally will be transverse across the top of the key 38 when said key is being held within the card while bands 42 and 44 will be supporting the underside of said key.

FIG. 4 discloses still another alternative embodiment of the present invention. This card is designed to hold two keys 38 of any normally used size, shape or thickness. The card 1 has a single rectangular recess 20 at the lower right hand corner which allows for the insertion of an emergency information label 20. The card has two apertures 45 and 47 within which the keys 38 are intended to be placed. The keys are then held in place within the aperture by bands 48, 50 and 52. The three bands are intended to hold the key 38 in place with two bands, 50 and 52, intended to transverse the key on one side and band 48 to transverse the key on the other. These bands 48, 50 and 52, as bands 40, 42, 44 and 46 discussed above, are integrally attached to either side of the key aperture and are of approximate one-half the thickness of the card 1. The apertures 45 and 47 are each in the general shape of a key and arranged longitudinally one next to the other with the said arrangement allowing for the shaft of each key to be pointing in an opposite direction. This allows the apertures to be placed much closer to each other, thereby decreasing the necessary size of the card and providing for a more economical and convenient key holder card. Also in this embodiment are apertures 21 corresponding to three toothpicks 22, said toothpicks being held within the apertures 21 of the card by the tab 14 and recess 15 arrangement as described above.

Figure 5:
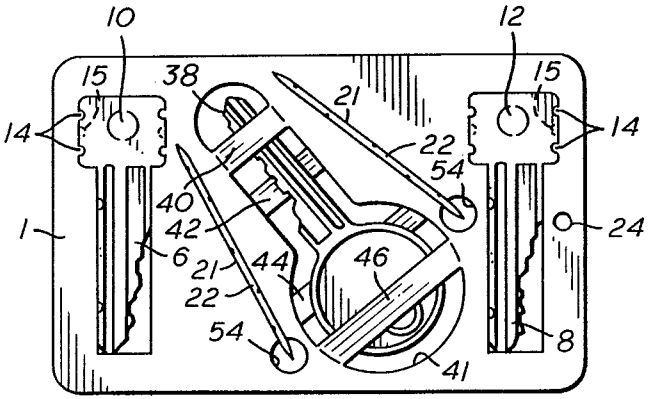
FIG. 5 is a plan view of still another embodiment of the present invention.

FIG. 5 discloses still another alternative embodiment of the present invention. As shown in FIG. 5 two emergency keys 6 and 8 are located longitudinally parallel to each other and retained within corresponding apertures 5 and 7 in the same position. The keys are retained within the apertures by tabs 14 and corresponding recesses 15 as described above. A third key aperture 41 is defined within the card 1 at a diagonal between the emergency keys 6 and 8. The aperture 41 is designed to hold a key 38 of any generally used size, shape and thickness. The key 38 is retained within aperture 41 by four bands, 40, 42, 44 and 46 arranged as described above with respect to FIG. 3A. Along side of aperture 41 are two other apertures 21 corresponding to toothpicks 22; these toothpicks 22 being retained within the apertures 21 by tabs 14 and recesses 15, just as the toothpicks described above. This embodiment also contains a circular aperture 54 located at the end of each toothpick aperture 21 such that the tips of the toothpicks 22 penetrate the interior of the circular apertures 54 to allow for easy removal from the card.

FIG. 6 also discloses an alternative of the present invention wherein two toothpicks 22 are horizontally parallel and retained in corresponding apertures 21 with circular apertures 54 located at either end of both toothpick apertures 21. A key aperture 17 is also defined within the card longitudinally parallel with the toothpick apertures 21. The key aperture 17 is of the type described above wherein any average key can be retained within the aperture 17 of the card 1, by bands 40, 42, 44 and 46 longitudinally transversing the key aperture 17.

Figure 7B:
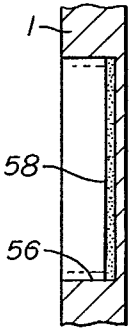
FIG. 7B is a cross-sectional view along line 7B—7B of FIG. 7A.
Figure 7A:
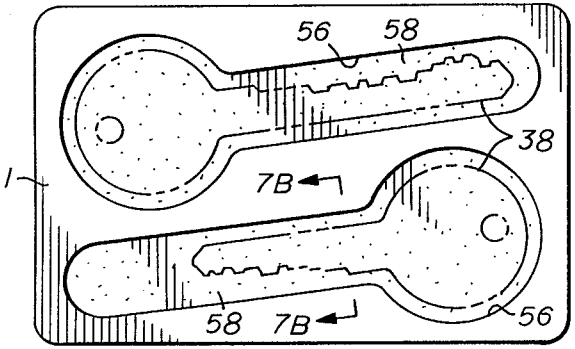
FIG. 7A is a plan view of still another embodiment of the present invention showing two recessed compartments for emergency keys.

FIG. 7 discloses an emergency key holder card 1 with two key shaped recesses 56. The recesses 56 are aligned substantially opposite of each other with the shaft section of each targeted in an opposite direction to allow for efficient and convenient placement. The recesses 56 are able to retain keys 38 by means of an adhesive material 58 placed at the bottom of the recesses 56. The adhesive 58 can be two sided tape or other similar type material. The coefficient of adhesiveness must be sufficiently high to retain the keys 38 within the recess 56 when the keys are not removed for use.

Figure 8:
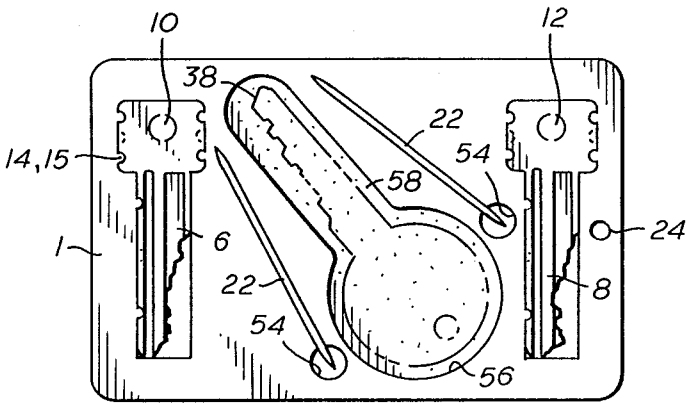
FIG. 8 is a plan view of another modification of the present invention.

FIG. 8 discloses an embodiment which contains a diagonally aligned single recess 56 with an adhesive bottom 58 with two emergency keys 6 and 8 all these arranged and aligned as the apertures 5, 7 and 41 described above with respect to FIG. 5. The two keys 6 and 8 are retained by the tabs 14 and recess 15 arrangements also described above. Indeed, this arrangement is identical to the arrangement as described with respect to FIG. 5 above; except the center diagonal means for holding the key is a recessed adhesive compartment as opposed to a key shaped aperture with restriction bands to retain the key within the aperture.

Figure 9A:
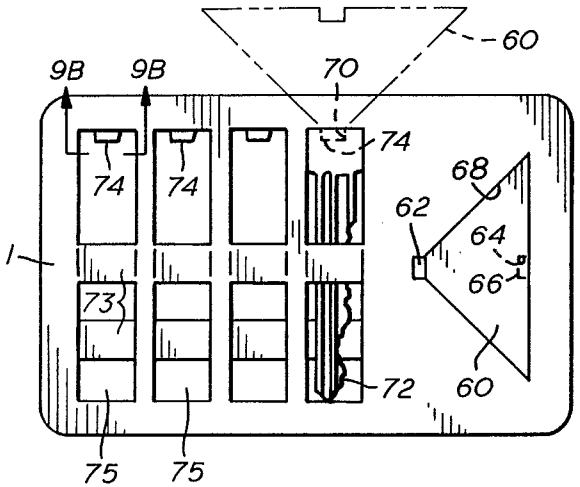
FIG. 9A is still another embodiment of the present invention disclosing four key shafts and one key head retained within a single emergency key holder card.
Figure 9B:
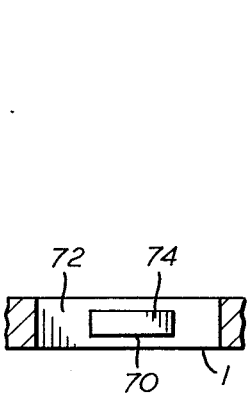
FIG. 9B is a cross-sectional view along line 9B—9B of FIG. 9A.

FIG. 9A discloses a new and innovative emergency key arrangement. The key holder card 1 retains a triangular shaped key head 60 and up to four key shafts constructed of metal or plastic 72. A triangular aperture 68 is defined within the card 1. The pinnacle of the triangular shaped key head 60 is integrally attached to a male peg member 62. Defined within and located at the bottom of the key head 60 equidistant from each bottom corner is a rectangular female recess 64 which corresponds to the male rectangular peg 66 which in turn is integrally attached to the card 1 and extends from card 1 into the triangular aperture 68. A plurality of tabs 14 are located along each side of the key head aperture 68, said tabs corresponding to recesses 15 along the key head 60 itself. The key head 60 is therefore easily separable from the card 1 and easily replaced. One or more key shafts 72 are retained in a longitudinally parallel fashion within corresponding apertures 75 of the card 1. Defined within the top of each shaft 72 there is located a rectangular female recess 70 which corresponds to a male peg 74 which is integrally connected to the card 1 and extends downward into apertures 72. The key shaft 72, while being retained within the corresponding apertures of card 1, is held in place by inserting the pegs 74 into the corresponding recesses 70. Further support to retain the shafts in the apertures of card 1 is maintained by bands 73 which horizontally transverse the longitudinal key shaft apertures 71, the bands 73 being integrally attached to the card 1.

Figure 10A:
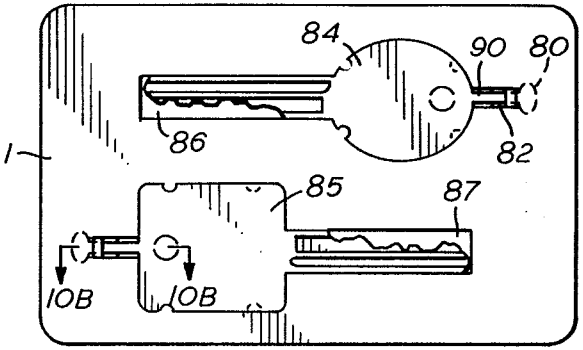
FIG. 10A is another embodiment of the present invention showing two emergency keys pivotably attached to the emergency key holder card.
Figure 10B:
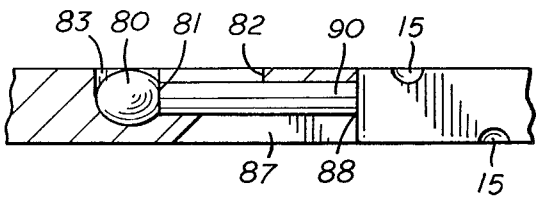
FIG. 10B is a cross-sectional view along line 10B—10B of FIG. 10A.
Figure 10C:
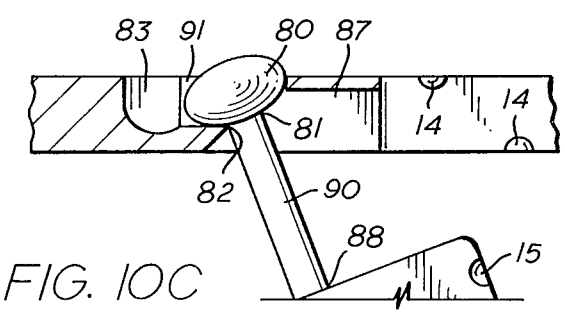
FIG. 10C is the same view as FIG. 10B with the emergency key being separated from the emergency key holder card.

FIG. 10A shows still another embodiment of the present invention. In FIG. 10, two keys 84 and 85 are retained within their corresponding recesses 86 and 87 respectively. The recesses are geometrically arranged such that the key shafts point in direct opposite directions of each other. Each key is pivotably attached to the card 1. The head of each key is integrally attached to a cylindrical shaft 90 at 88. The shaft then passes through a circular aperture 82 and integrally connects to a rounded head 80 at 81 on the opposite side of the card 1 from the keys 84 and 85. The keys are retained in the apertures by tabs 14 and recesses 15 as described above. When separated from the aperture and card the key remains rotatably attached to the card via the shaft 90 with shaft head 80. A recess 83 is provided for the shaft head 80 so that when the keys 84 and 85 are being retained in the corresponding apertures 86 and 87, the head 80 will lie within the recess 83 such that it does not protrude substantially above the plane of the card 1. A channel 91 extends outward from recess 83, said channel corresponding to and containing the shaft 90 when the keys 84 and 85 are retained within their corresponding apertures. Similarly, a channel 87 is also provided on the side of the card opposite the head 80, said channel 87 extending horizontally outward from the key head portion of apertures 86 and 87. Therefore the shaft 90 extends from the key head, along channel 87 through aperture 82 and along channel 91 to the head 80. The far end of said channel 87 is beveled outwardly to allow the shaft 90 and similarly the keys 84 and 85 to rotate backward from the key apertures 86 and 87 almost 180°.

Figure 11D:
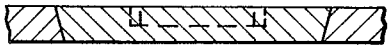
FIG. 11D is a cross-sectional view taken along line 11d—11d of FIG. 11A.
Figure 11C:
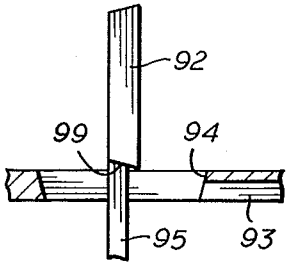
FIG. 11C is the same view as in FIG. 11B with the key being separated from the card thereby demonstrating the hinge action.
Figure 11A:
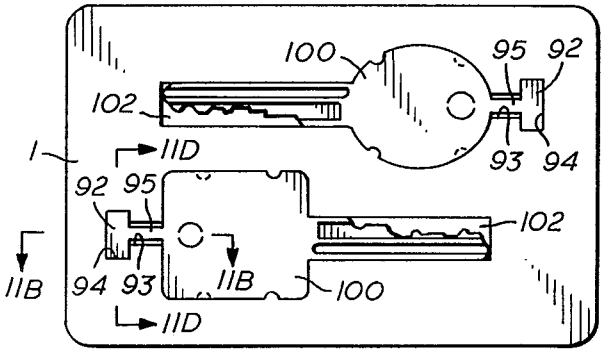
FIG. 11A is a plan view of still another embodiment of the present invention disclosing two emergency keys hingedly attached to the key holder card body and retained within the appropriate apertures by tabs.
Figure 11B:
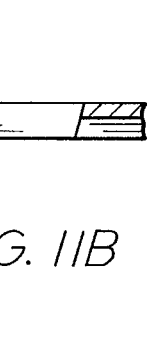
FIG. 11B is a cross-sectional view taken along line 11B—11B of FIG. 11A.

FIG. 11A discloses another embodiment of the present invention. In this embodiment as shown, the two emergency keys 100 are hingedly attached to the card 1 by a beveled hinge arrangement. As shown, the keys are retained co-planar to each other and the card 1 within apertures 102 defined within the card. The keys 100 are aligned such that the shafts 95 point to opposite vertical edges of the card 1. Integrally attached to the top of each key 99 and 100 is a shaft 95. The shafts 95 are attached to the key at 99. The shafts 95 are in turn integrally attached to a rectangular member 92 with beveled edges angled downward and outward. Rectangular apertures 94 are defined within card 1 just above each key aperture 102. The rectangular beveled member 92 rests within aperture 94 comprised of corresponding beveled edges when the keys 100 are being retained within the card by tabs and recesses, 14 and 15 respectively as described above. A channel 93 extends perpendicularly outward from the center top of the key aperture 102 into the beveled rectangular aperture 94. The channel 93 corresponds and retains the shaft 95 when the keys 100 are being retained within their corresponding apertures 102. The channel 93 is located on the side of the card that the key is intended to hinge away from. Therefore, the shaft 95 when integrally connecting to both the beveled section 92 and keys 100 is only approximately one-half to three-fourths the thickness of either. Indeed, the beveled sections 92 and keys 100 are generally to be of the same thickness as the card 1. Therefore, the shaft 95 is generally one-half to three-fourths the thickness of the card. The beveled section 92 while shown in a rectangular shape can also be oval, circular or generally any aesthetically pleasing and functional geometric shape. However, the bevel must always be outward and towards the side of the card away from which the keys 100 will hinge.

Figure 12B:
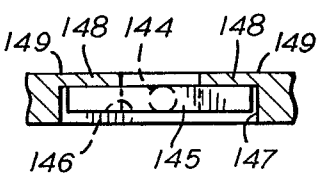
FIG. 12B is a cross-sectional view along line 12B—12B of FIG. 12A.
Figure 12A:
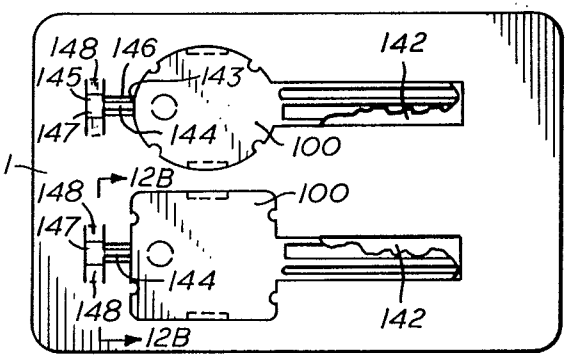
FIG. 12A is a plan view of another embodiment of the present invention showing two emergency keys hingedly attached to the key holder card by a hinge means alternative to that disclosed in FIG. 11A.

FIG. 12 shows yet another embodiment of the present invention which comprises two emergency keys being hingedly retained within, and co-planar to, the card 1. In this embodiment the two emergency keys 100 are hingedly attached to the card 1 by a recessed hinged means. As shown, defined within the card 1, there are two emergency key apertures 142. Also, as shown integrally attached to and extending perpendicularly outward from the top center of each emergency key 100 are shafts 144. The shafts 144 are integrally attached to the emergency keys 100 at 143. The shafts 144 are in turn integrally attached to perpendicular hinge members 145. Extending perpendicularly outward from the top center of each emergency key aperture 142 defined within the card 1 ar recessed channels 146. Within these channels are maintained the shafts 144. The channels 146 extend directly up to perpendicular apertures 147 also defined within card 1. The apertures 147 will retain the rectangular hinge member 145. Extending outward from each end of the apertures 147 are flaps 148, said flaps 148 being approximately one half the thickness of said card 1. These flaps extend over the majority of the aperture 147 leaving open a space only marginally greater then the width of the shafts 144. The flaps 148 are integrally attached to the card 1 at points 149. The other two sides of each flap 148 which abut the card 1 are neither fixably nor integrally attached, thus allowing each flap to move up or down relative to the card 1. This design allows each key to be hingedly rotated away from the face of the card or, if desired, the key can be completely separated from the card 1 by pulling each hinge member 145 out of the aperture 147 through flaps 148. Tabs 14 and recesses 15 are arranged around each key aperture 142 and each key 100 respectively so that the key can be snapped into place and completely retained within the card 1 and co-planar thereto.

Figure 13B:
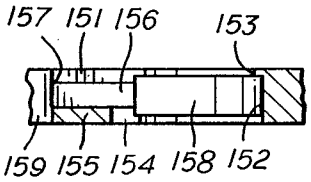
FIG. 13B is a cross-sectional view along line 13B—13B of FIG. 13A.
Figure 13A:
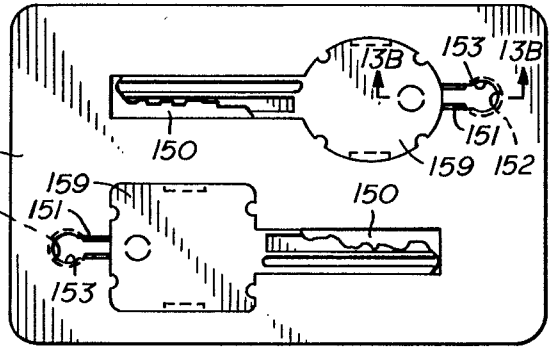
FIG. 13A is a plan view of another embodiment of the present invention showing two emergency keys hingedly attached to the emergency key holder card portraying still another hinged design different from those disclosed in FIGS. 12 and 13.

With respect to FIG. 13 and as discussed in the immediately preceding paragraph each emergency key 100 is retained within and co-planar to the card 1. Extending perpendicularly outward from the top center of each key aperture 150 are recessed channels 151. These channels extend from the key apertures 150 to the circular hinged receiving apertures 152. Each hinged member receiving aperture 152 maintains an overhang 153 which extends just over the corresponding back face aperture 154. The thickness of the overhang is no more than one-half the total thickness of the card 1. A square or rectangular extrusion 155 of the circular aperture 152 extends into, is received by and defined within the channel 151 which directly abuts the aperture 152. Each emergency key 100 to be used with this design comprises a single rectangular or square member 156 which extends perpendicularly outward from the top center of each emergency key 100. The member rectangular or square 156 is integrally attached to the key 100 at 157. Also integrally attached to the opposite end of said member 156 from the emergency key 100 is a circular hinge piece 158. This hinge piece 158 is of the same or marginally less diameter as the back face radius of aperture 152, 154. The rectangular extrusion 155 of aperture 152 allows the circular hinge piece 158 to be inserted through aperture 152. This can be done only when the key 100 is relatively perpendicular to the card 1. Once the circular hinge piece 158 has been threaded through aperture 152 the key can be flattened and placed into its appropriate aperture 150. A tab 14 and recess 15 arrangement is placeed about each key head 159 in the corresponding section of each key aperture 150. The combination of the tab 14 and recesses 15, the duel diameter circular aperture 152 and the corresponding circular hinge member 158 allow the key to be retained co-planar to and within the card 1.

Figure 14:
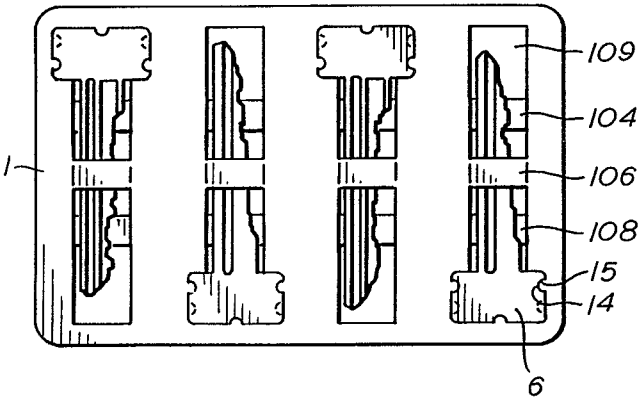
FIG. 14 is a plan view of another embodiment of the present invention showing four emergency keys retained within the emergency key holder card by bands.

FIG. 14 shows an embodiment of the present invention which comprises four emergency keys 6 with significantly reduced key heads intended for emergency use only. The four keys 6 are retained in individual key shaped apertures 109. The apertures are defined within the card and arranged longitudinally parallel. The present embodiment would work equally as well with less than four emergency keys. While normal keys possess a key head of substantial size to allow for easy grasping and turning of the key. These keys need not have heads of such size since they are intended for rare and emergency use. The keys themselves can be comprised of either metal or plastic. The keys are retained within four individual corresponding longitudinally parallel apertures 105 with every other key head retained in close proximity to the same key card edge. That is, every other key shaft is directed in opposite to the one or ones in closes proximity thereto. The key shafts themselves are retained by the bands 104, 106 and 108 every other band 104, 106 and 108 intended to transverse the key shaft on opposite sides of said shaft. The key heads are retained using the plurality of tabs and recesses, 14 and 15 as described above with the tabs 14 extending inward from the edges of apertures 109 corresponding to recesses 15 in the key heads.

Figure 15B:
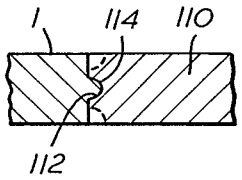
FIG. 15B is a cross-sectional view along line 15B—15B of FIG. 15A.
Figure 15A:
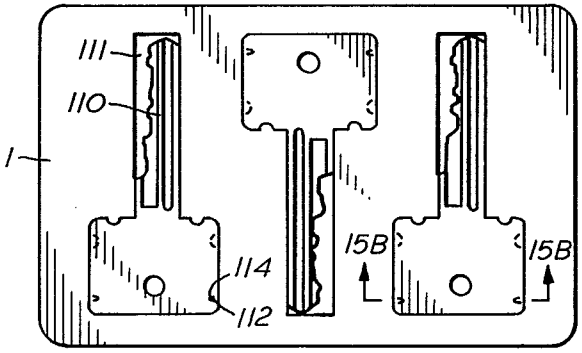
FIG. 15A is another embodiment of the present invention showing three emergency keys retained within an emergency key holder card and hinged using a male/female connection at opposite sides of the top portion of each key head.

FIG. 15 discloses another embodiment which comprises key shaped apertures 111 defined within a card 1 for three keys 110, each retained in individual apertures 111 which are longitudinally parallel. Each key shaped aperture 111 is defined, and key 110 is retained such that every other shaft extends in an opposite direction but remains co-planar with the others. This geometric arrangement allows for the compact and convenient placement of the apertures 111 and corresponding keys 110 substantially close to each other such that the emergency key holder card 1 can be of a small enough size to fit in a wallet or billfold. The keys are retained within the apertures using a combination tab and recess arrangement as described above, as well as a male and female connection 112 and 114, respectively. The pin 112 and recess 114 arrangement is located such that the male pin 112 extends outward from the card 1 into the apertures for the keys 111. A single recess 114 is located on either vertical edge of each key head just below the top of the key head, said recesses corresponding to pins 112. This provides an axis, about which the key can be rotated, which extends horizontally from one male/-female connection to the other for each key. This arrangement is more clearly shown in FIG. 15B. Since the key rotates about a male/female connection 112 and 114, the key is also completely removable from the apertures because it is not fixably attached at any point to the card itself.

Figure 16B:
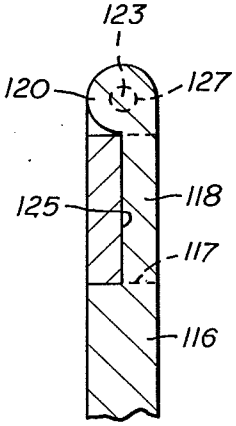
FIG. 16B is a cross-sectional view along line 16B—16B of FIG. 16A.
Figure 16A:
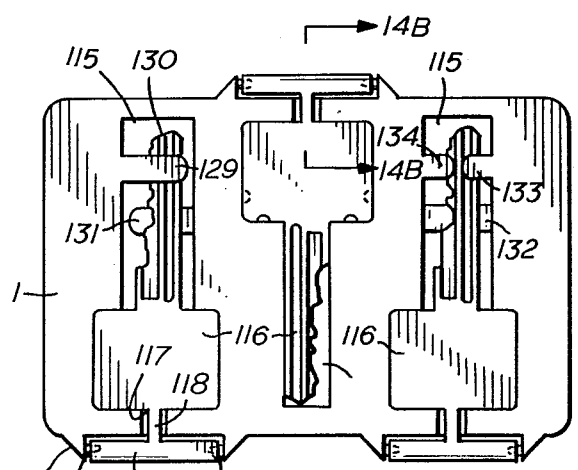
FIG. 16A is another embodiment of the present invention showing emergency keys hingedly retained within the emergency key holder card said hinges being outside of the general rectangular shape of the card.

FIG. 16A discloses an embodiment of the present invention which also allows the keys to be hingedly attached and retained within the card 1. In this case the keys are arranged in the same geometric set up as described in the immediate preceding paragraph. The hinges however are outside the general rectangle of the card I. Each key 116 is integrally attached to a shaft 118 at 117, said shaft 118 extending co-planar and outward from the top of each key 116. This shaft is in turn perpendicularly attached to a horizontal cylindrical member 120 with cylindrical recesses 121 defined within and at either end of said horizontal member 120. These recesses 121 correspond to male pegs 123 which are integrally attached to triangular supports 122, said supports being in turn integrally attached to and extending co-planarly outward from the card 1. The shafts 118 are recessed in channels 125, said channels extending perpendicularly outward from the center top of each key aperture 115 through to the immediate card edge. The keys can be retained in the apertures 115 by using either the tab and recess 14 and 15 arrangement described above or bands which transverse a portion of the aperture 115 within which the key shafts are retained.

When bands are used to retain the key within the aperture 115, the band 129 transversing the aperture 115 closest to the key shaft tip 130 cannot be fixably or integrally attached to both sides of the aperture 115. For the band or bands below the key head such as 131 or 132, it may or may not be desired to integrally or fixably attach them to both sides of the aperture 115. As shown, band 131 extends outward from the card, transversing the key aperture 115, but does not extend completely to the other side of the aperture. While band 132 is integrally attached to both sides of the aperture 115 transversing said aperture, the next and only other band transversing the key shaft such as 129 or 133/134 is found to substantially transverse the aperture 115 but yet allow the key to pass through the aperture at that point. The band 129 is of a single piece construction extending horizontally outward from card 1 transversing key aperture 115 to a point substantially near the opposite side of the key aperture 115. The duel bands 133 and 134 act in substantially the same way; yet both extend inward from the card transversing the aperture 115 at points directly opposite of each other, are of approximately the same length said length being no more then one-half the width of the aperture 115 at the point 133 and 134 are transversing said aperture. Since the keys 116 are not fixably attached to the card 1 at any point they may be completely removed from the card as well as rotated about the hinged axis 360°. FIG. 14B shows the hinge arrangement in greater detail.

Figure 17:
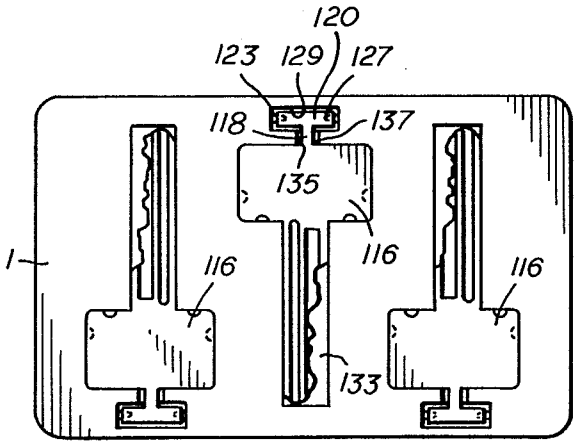
FIG. 17 is a plan view of still another embodiment of the present invention showing emergency keys hingedly retained within the rectangular emergency key holder card.

FIG. 17 shows substantially the same hinge arrangement for retaining the keys 116 within card 1 with the only differences being the hinges are contained within the rectangular outline of the card 1. The key head is integrally attached at its center point 137 to a shaft 118 which in turn is attached to a cylindrical, or rectangular horizontal member 120 which contains cylindrical recesses at either end 127. The recesses 127 accept male pegs 123, said male pegs 123 being integrally or fixably attached to the card 1. Further, the key apertures 133 defined within the card 1 for the key extend upward from the center key head point 137 defining a channel 135 said channel being of a length just less than the length of the shaft 118. The channel 135 extends into a rectangular aperture 129, also defined within the card 1. Defined within is the rectangular aperture 129 at either end are recesses 120 and into which either end extends the male pegs 123. The aperture 129 must be of a length which allows the male pegs 123 to be accepted into the cylindrical recesses 127 of horizontal member 120; thereby allowing an axis of rotation for the keys 116 to be developed along a line extending between the two pegs 123 on either end of the horizontal aperture 129.

Figure 21:
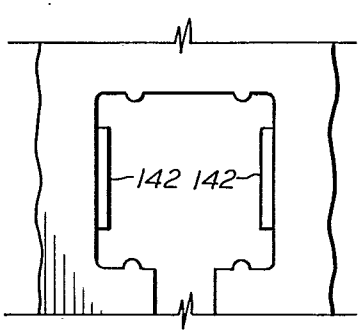
FIGS. 18–21 show various tab arrangements including various sized and geometrically shaped tabs to be used to retain keys within the emergency key holder card.
Figure 20:
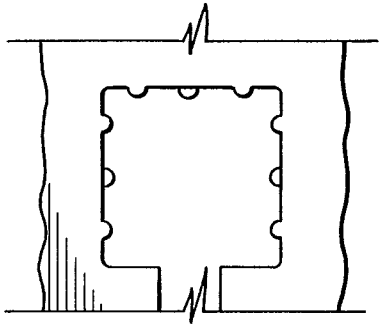
Figure 19:
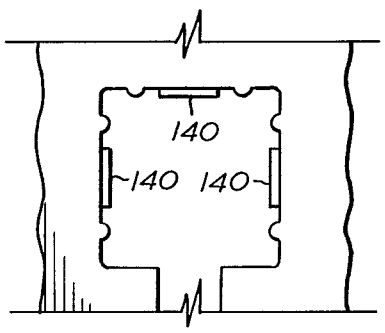
Figure 18:
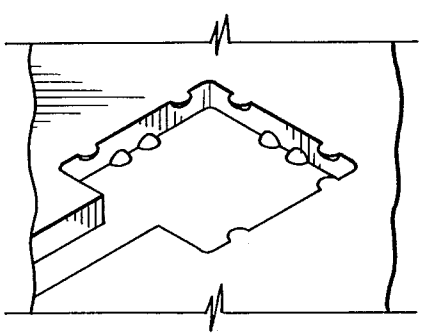

Regarding the tab 14 and recess 15 arrangement described above, it must be pointed out that the tabs extending outward from one side of the card 1 into the key aperture must be off-set from any tabs extending into the aperture on the opposite side of the card. This design greatly facilitates use of the generally accepted manufacturing process of injection molding. It is noted that each and every design disclosed and claimed herein contains no horizontal recesses or indentions thereby also facilitating use of the injection molding manufacturing process. While any number of tabs can be spaced about the key apertures on the card as pointed out, none can extend out directly over tabs on the opposite side. The tabs can also be arranged using any general design or width. FIGS. 19 and 21 show tabs 140 and 142 of rectangular geometric shape. These tabs will correspond to similar shaped recesses within the key head. FIGS. 18 and 20 also show other arrangements of the tabs.

As a substitution for the tab and recess means for retaining emergency keys within the key holder card, the present invention can be manufactured such that the keys and corresponding apertures are of sufficiently the same size. This will allow the keys to be retained within the apertures without any secondary means of retaining. The keys will simply fit snugly within the aperture and will be easily removable upon demand.

One may also reverse locations of the tabs and recesses 14 and 15. That is, the tabs 14 could be on the key and the recesses 15 could be defined within the card 1.

Thus it is apparent that there has been provided in accordance with the instant invention a new and improved emergency key holder card apparatus to enhance and improve the convenience of accessability of the average individual house and automobile key. While this invention has been described with specific embodiments thereof, in light of the foregoing description, it is evident that many alternatives, modifications and variations will be apparent to those skilled in the art. Accordingly, this patent is intended to embrace all such alternatives, modifications and variations as falls in the spirit of the invention and scope of the appended claims.

What is claimed is:

1. An emergency key holder card comprising:

a. a single rectangular credit card sized body of similar dimensions as a credit card;

b. two longitudinally parallel emergency key apertures located within said card body;

c. two emergency keys of substantially the same shape as said apertures;

d. a means of retaining said emergency keys within said apertures; and e. a plurality of tabs placed intermittently about said key retaining aperture, said tabs extending outward from said card body to said aperture from both sides of said card each tab being offset from any other tab and corresponding to a recess in the emergency key intended to be retained within said aperture.

2. An emergency key holder card comprising:

a. a single rectangular body of similar dimensions as a credit card;

b. three key shaped apertures defined within and along the plane of said card;

c. a plurality of tabs placed intermittently about two of said apertures, said tabs extending outward from said card body into said aperture from both sides of said card; each tab being off-set from any tab extending from the opposite side of said card and conforming to a recess in each emergency key intended to be retained within said apertures; and;

d. three or more parallel bands integrally attached to said card and extending transversely across the third key aperture, said bands approximately one-half the thickness of said card, the tops of two bands co-planar with one face of said card with the tops of the other two bands co-planar with the other face of said card.

* * * * *